US007021567B2

(12) United States Patent
Potz et al.

(10) Patent No.: US 7,021,567 B2
(45) Date of Patent: Apr. 4, 2006

(54) FUEL INJECTION VALVE FOR INTERNAL COMBUSTION ENGINES

(75) Inventors: Detlev Potz, deceased, late of Stuttgart (DE); by Maike Sander-Potz, legal representative, Stuttgart (DE); by Wendelin Potz, legal representative, Stuttgart (DE); Thomas Kuegler, Korntal-Muenchingen (DE); Andreas Koeninger, Neulingen-Goebrichen (DE); Predrag Nunic, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/514,827

(22) PCT Filed: Mar. 25, 2003

(86) PCT No.: PCT/DE03/00973

§ 371 (c)(1),
(2), (4) Date: Nov. 17, 2004

(87) PCT Pub. No.: WO03/098028

PCT Pub. Date: Nov. 27, 2003

(65) Prior Publication Data

US 2005/0224598 A1 Oct. 13, 2005

(30) Foreign Application Priority Data

May 18, 2002 (DE) ..... 102 22 196

(51) Int. Cl.

| | |
|---|---|
| ***F02M 45/00*** | (2006.01) |
| ***F02M 61/06*** | (2006.01) |
| ***F02M 59/00*** | (2006.01) |
| ***F02M 61/00*** | (2006.01) |
| ***F02M 63/00*** | (2006.01) |

(52) U.S. Cl. ..... 239/533.4; 239/533.2; 239/533.3; 239/88; 239/96

(58) Field of Classification Search ..... 239/88–96, 239/533.2, 533.3, 533.4, 533.8, 533.9, 563
See application file for complete search history.

(56) References Cited

U.S. PATENT DOCUMENTS

| | | | | |
|---|---|---|---|---|
| 6,220,528 | B1 * | 4/2001 | Cooke et al. | 239/533.3 |
| 6,340,121 | B1 * | 1/2002 | Lambert | 239/533.4 |
| 6,378,503 | B1 * | 4/2002 | Lambert | 123/468 |
| 6,705,543 | B1 * | 3/2004 | Carroll et al. | 239/96 |

FOREIGN PATENT DOCUMENTS

WO WO 02/077442 * 10/2002

* cited by examiner

*Primary Examiner*—David A. Scherbel
*Assistant Examiner*—Darren Gorman
(74) *Attorney, Agent, or Firm*—Ronald E. Greigg

(57) ABSTRACT

A fuel injection valve for internal combustion engines, having a housing with a bore inside it that contains a longitudinally sliding outer valve needle which in turn contains a longitudinally sliding inner valve needle and the end of each valve needle oriented toward the combustion chamber controls at least one injection opening. The pressure in a control pressure chamber at least indirectly exerts a closing force on the outer valve needle and the pressure in a control pressure chamber at least indirectly exerts a closing force on the inner valve needle. The housing contains a control valve that has a valve chamber and a valve element contained in it, wherein the valve chamber has a connection to the leakage oil chamber a continuously open connection to the control chamber and a connection to the control pressure chamber. The valve element can move between a end position, the valve element closing the connection to the leakage oil chamber and opening the connection to the control pressure chamber and a second end position, closing the connection to the control pressure chamber and opening the connection to the leakage oil chamber.

8 Claims, 4 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 03/00973 filed on Mar. 25, 2003.

BACKGROUND OF THE INVENTION

1. Field of the Invention

The invention is directed to an improved fuel injection valves of the type that have two valve needles guided one inside the other.

2. Description of the Prior Art

Fuel injection valves of the type which this invention is concerned are known, for example, from German Patent Disclosure 41 15 477 A1. At their ends oriented toward the combustion chamber, the two valve needles each control at least one injection opening and can be triggered so that either only the outer valve needle opens part of the injection openings, or both valve needles open, thus opening all of the injection openings. This allows the injection cross-section to be optimally adjusted as a function of the load of the internal combustion engine. The longitudinal movement of the valve needles in the bore is governed by the relationship between an opening force acting on the valve needles and a counterpoised closing force. The opening force is generated by the hydraulic pressure on corresponding pressure surfaces of the valve needles, while the closing force in the known fuel injection valves is generated either by springs or by hydraulic forces. The known fuel injection valve has the disadvantage the it is not possible to freely control the opening time and opening duration of the two needles. The outer valve needle opens in a pressure-controlled manner in opposition to the force of a closing spring, while the inner valve needle—in addition to the closing force of a closing spring—is subjected to a force generated by the hydraulic pressure in a control chamber. A solenoid valve, however, can only control whether or not the inner valve needle opens during an injection cycle. The solenoid valve cannot influence the opening behavior of the outer valve needle. This limits the control of the exact onset of injection and the precise injection quantity, which naturally also makes it harder to further optimize combustion.

SUMMARY AND ADVANTAGES OF THE INVENTION

The fuel injection valve according to the invention has the advantage over the prior art that a single control valve can control the opening time and opening duration of both the outer and the inner valve needle. To this end, the control valve contained in the housing of the fuel injection valve has a valve chamber that contains a valve element. The valve element can move between two end positions. In its first end position, the valve element assures that both the control chamber and the control pressure chamber are filled with highly pressurized fuel so that both the outer valve needle and the inner valve needle remain in their closed positions. If the valve element moves rapidly into its second end position, then only the control chamber is pressure-relieved into the leakage oil chamber, while the control pressure chamber retains practically all of its pressure. This causes only the outer valve needle to open, while the inner valve needle remains in its closed position. If both valve needles are to be opened, i.e. both the inner and outer valve needle, then the valve element travels somewhat slower from its first end position to the second end position, which causes the pressure in the control pressure chamber to drop until in addition to the outer valve needle, the inner valve needle also opens. The switching time of the control valve can thus be used to control whether the entire injection cross-section or only part of the injection cross-section is opened. It is possible to control the Coaxial Vario Nozzle by means of only a single control valve.

In an advantageous embodiment of the subject of the invention, the valve element is moved by an actuator that is preferably operated electrically. It is particularly advantageous to embody the actuator as a piezoelectric actuator since this has the advantage of the capacity to be switched at virtually any speed. The valve element moved by the actuator can therefore travel from the first end position to the second end position at a variable speed, which makes it possible to control the injection cross-section by means of the switching speed.

BRIEF DESCRIPTION OF THE DRAWINGS

Other features and advantages of the invention will become apparent from the detailed description contained herein below, taken in conjunction with the drawings, in which.

DESCRIPTION OF THE PREFERRED EMBODIMENT

Figure 1:
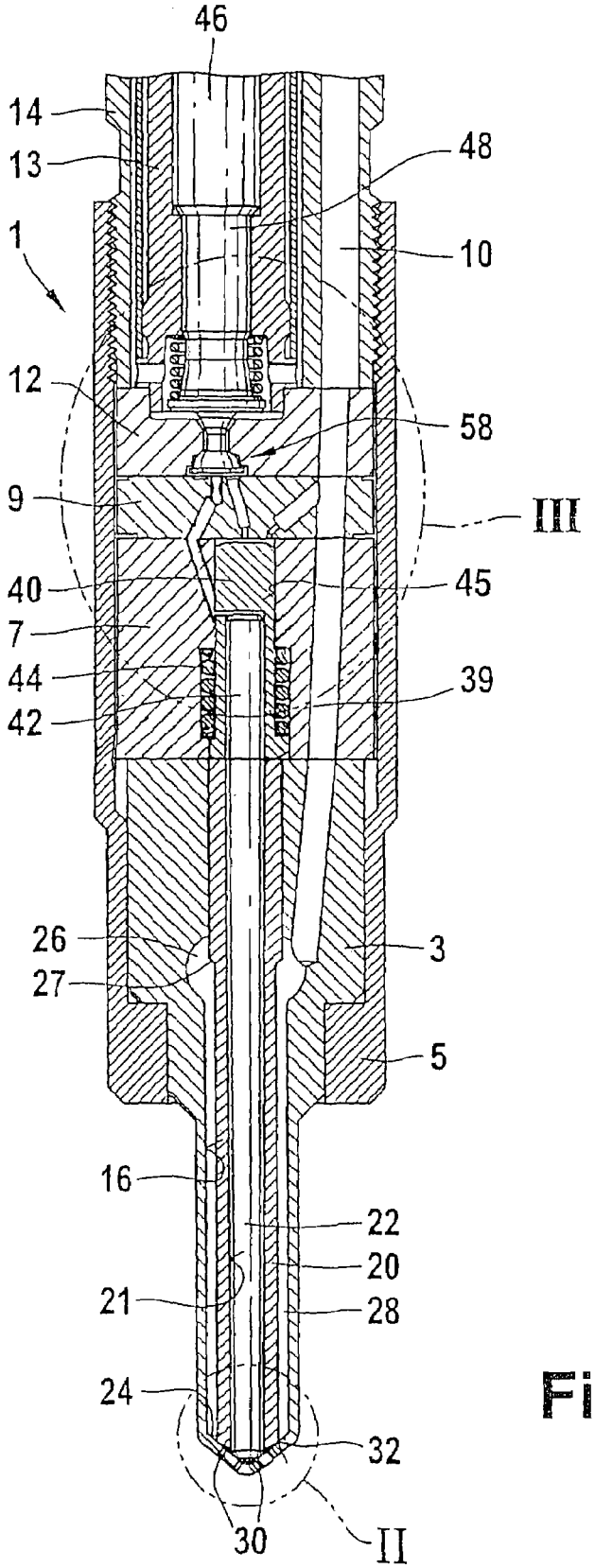
FIG. 1 shows a longitudinal section through a fuel injection valve according to the invention.
Figure 2:
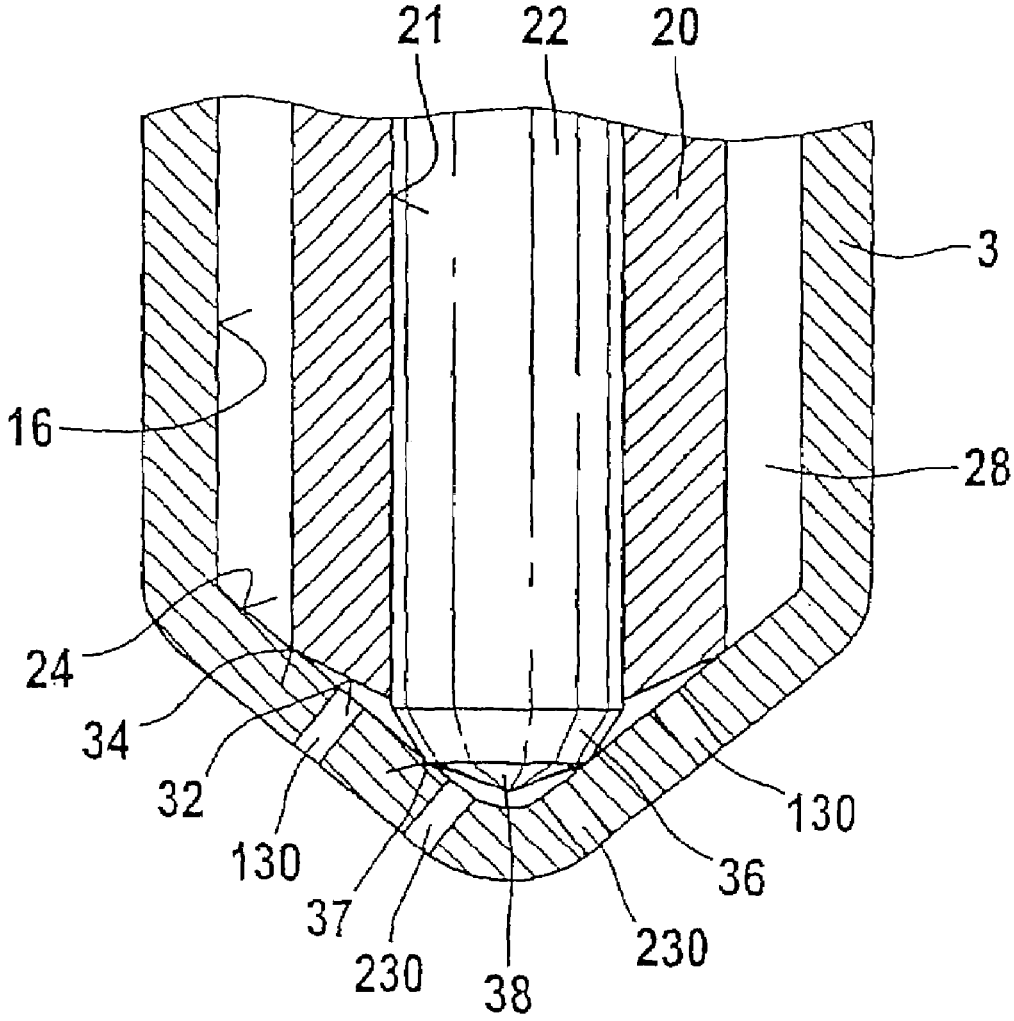
FIG. 2 shows an enlarged view of the detail labeled II in FIG. 1.

FIG. 1 shows a longitudinal section through a fuel injection valve according to the invention. The fuel injection valve has a housing 1, which includes a holding body 14, a control body 12, an intermediate disk 9, an intermediate body 7, and a valve body 3 disposed one against the other in this sequence. A retaining nut 5 presses the individual components of the housing 1 against one another and fixes them in position in relation to each other. The valve body 3 contains a bore 16 in which an outer valve needle 20 can slide longitudinally. The outer valve needle 20 is guided in the bore 16 in a section oriented away from the combustion chamber and tapers toward the combustion chamber, forming a pressure shoulder 27. The outer valve needle 20 extends to a seat surface 24, which is provided at the combustion chamber end of the bore 16 and contains a number of injection openings 30 that connect the seat surface 24 to the combustion chamber of the engine. Between the outer valve needle 20 and the wall of the bore 16, an annular conduit 28 is formed, which extends from the seat surface 24 to the level of the pressure shoulder 27. At the level of the pressure shoulder 27, the annular conduit 28 widens out into a pressure chamber 26 that is fed by an inlet conduit 10 extending through the valve body 3, the intermediate body 7, the intermediate disk 9, the control body 12, and the valve holding body 14. The fuel inlet conduit 10 can supply highly pressurized fuel to the pressure chamber 26 and therefore also to the annular conduit 28. The outer valve needle 20 has a longitudinal bore 21 that contains a longitudinally sliding inner valve needle 22. FIG. 2 shows an enlargement of the detail labeled II in FIG. 1 in order to clarify how the valve needles 20, 22 control the injection openings 30. The seat surface 24 is conical and the injection openings 30 are grouped into two arrays of injection openings, namely an outer array of injection openings 130 and inner array of injection openings 230. At its end oriented toward the combustion chamber, the outer valve needle 20 has a conical outer valve sealing surface 32 so that a sealing edge 34 is formed with which the outer valve needle 20 comes into contact with the seat surface 24 in its closed position. The outer array of injection openings 130, which is comprised of at least two injection openings 30 that are disposed in a radial plane in relation to the longitudinal axis of the bore 16, are situated downstream of this sealing edge 34. At its end oriented toward the combustion chamber, the inner valve needle 22 has an inner valve sealing surface 36 and a conical surface 38 and, at the transition between these two surfaces, a sealing edge 37 is formed with which the inner valve needle 22 rests against the seat surface 24 in its closed position. The inner array of injection openings 230, which is likewise comprised of at least two injection openings that are disposed in a common radial plane in relation to the longitudinal axis of the bore 16, open onto the seat surface 24 downstream of the sealing edge 37 of the inner valve needle 22.

The two valve needles 20, 22 cooperate to control the injection openings 30 in the following manner: if fuel is to be injected into the combustion chamber of the engine through only the outer array of injection openings 130, which is particularly advantageous when the engine is to be operated in a partial load range, then only the outer valve needle 20 lifts away from the seat surface 24 for the injection. As a result, highly pressurized fuel in the annular conduit 28 can flow between the outer valve sealing surface 32 and the seat surface 24 to the outer array of injection openings 130 and from there, is injected into the combustion chamber of the engine. In this case, the inner valve needle 22 remains in its closed position, i.e. in contact with the seat surface 24 so that the inner array of injection openings 230 remains closed. If an injection is to be executed using all of the injection openings 30, then the inner valve needle 22 also lifts up from the seat surface 24, thus also opening the inner array of injection openings 230.

Figure 3:
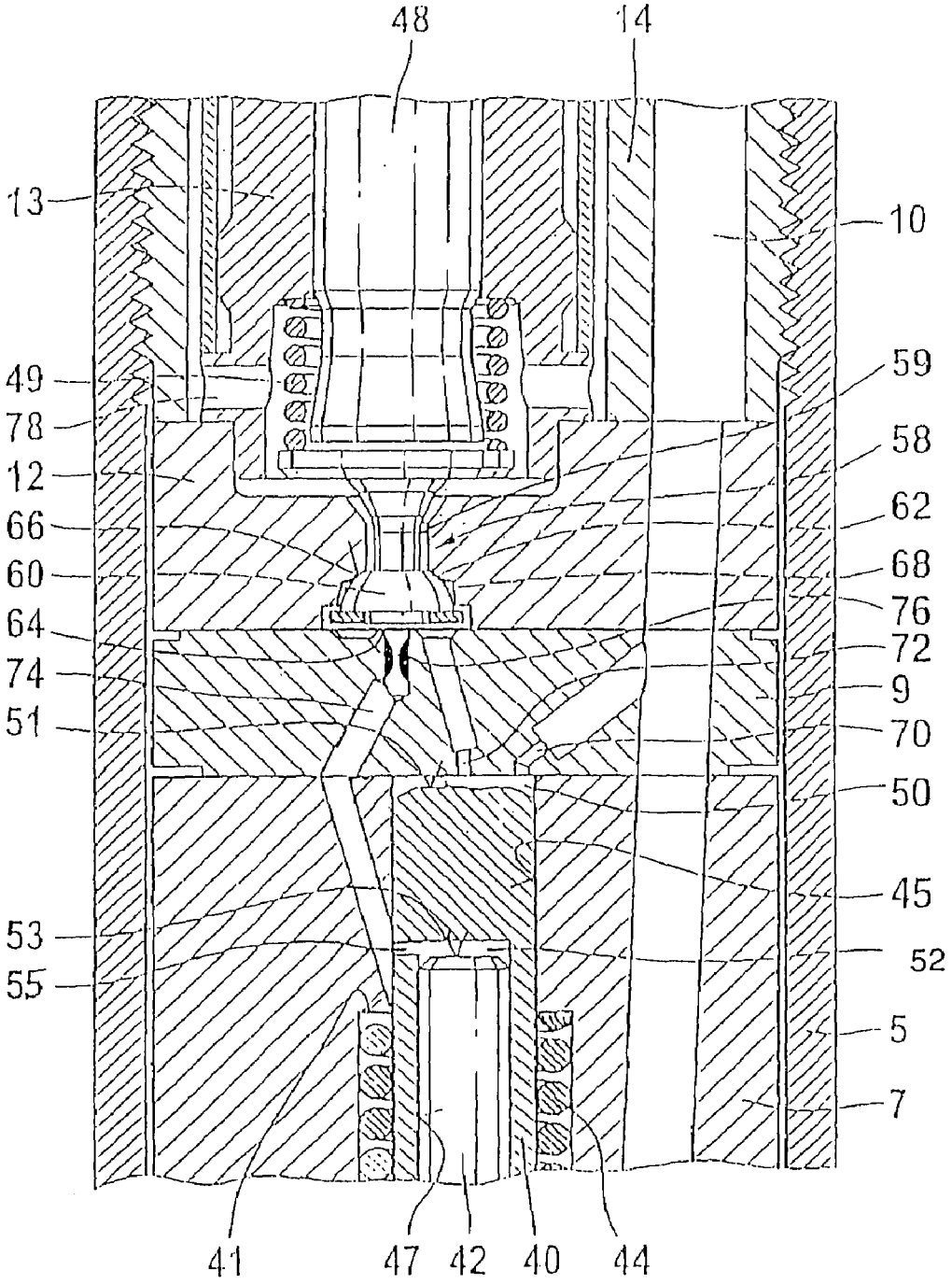
FIG. 3 shows an enlarged view of the detail labeled III in FIG. 1.

The devices contained in the intermediate body 7, the intermediate disk 9, the control body 12, and also the valve holding body 14 serve to control the two valve needles 20, 22. This section, labeled III in FIG. 1, is depicted in detail in FIG. 3. Coaxial to the bore 16, the intermediate body 7 contains a piston bore 45 whose diameter is stepped, forming a support surface 41. The receiving bore 45 contains an outer pressure piston 40 that rests against the outer valve needle 20 and can move synchronously with it in the longitudinal direction. An annular shoulder surface 39 is provided on the outside of the outer pressure piston 40 and a closing spring 44 is held with a compressive initial stress between this annular surface 39 and the support surface 41; this closing spring 44 is embodied as a helical compression spring and encompasses the outer pressure piston 40. The end surface 51 of the outer pressure piston 40, the intermediate disk 9, and the wail of the piston bore 45 delimit a control chamber 50 that communicates with the inlet conduit 10 via an inlet throttle 70 and in this case, serves as a high pressure chamber that always contains highly pressurized fuel. In addition to the force of the closing spring 44, the outer pressure piston 40 and therefore also the outer valve needle 20 are also subjected to the hydraulic force on the end surface 51, which is generated by the pressure in the control chamber 50.

The outer pressure piston 40 contains a guide bore 47 in which an inner pressure piston 42 is guided in a longitudinally sliding fashion. The inner pressure piston 42 rests against the inner valve needle 22 and always moves synchronously with it. The guide bore 47 and the end surface 53 of the inner pressure piston 42 delimit a control pressure chamber 52 whose pressure generates a hydraulic force on the pressure piston 42 and therefore also on the inner valve needle 22 in the direction of the seat surface 24.

The valve holding body 14 contains a receiving body 13, which contains an actuator 46 and a thrust element 48 connected to it. The actuator 46, which is preferably embodied as a piezoelectric actuator, moves the thrust element 48 in the longitudinal direction counter to or in the same direction as the force of a spring 49, which is disposed between the thrust element 48 and the receiving body 13. The thrust element 48 is connected to a valve element 60, which is contained in a valve chamber 68 embodied in the control body 12 and, together with a first valve seat 62 and a second valve seat 64 opposite it, constitutes a control valve 58. The valve element 60 is essentially embodied as a hemisphere; the hemispherical valve sealing surface 66 cooperates with the first valve seat 62 while the flat side of the valve element 60 cooperates with the second valve seat 64, which is embodied as a flat seat. The valve chamber 68 has a connection 59 to a leakage oil chamber 78 provided in the valve holding body 14; the connection 59 can be opened and closed by the valve element 60 through its cooperation with the first valve seat 62. The valve chamber 68 also has an outlet throttle 72, which connects the valve chamber 68 to the control chamber 50. The outlet throttle 72 here always remains open, independent of the position of the valve element 60. The interplay between the valve element 60 and the second valve seat 64 controls a connecting conduit 74 that produces a connection between the valve chamber 68 and the control pressure chamber 52. The connecting conduit 74 here extends into the intermediate body 7 and feeds laterally into the piston bore 45. The connection to the control pressure chamber 52 is produced by means of a lateral bore 55 in the outer pressure piston 40. This connection of the control pressure chamber 52 to the connecting conduit 74 is maintained in every position of the outer pressure piston 40. The connecting conduit 74 contains a throttle restriction 76 that can limit the possible fuel flow through the connecting conduit 74 and can also be omitted if necessary.

The control valve 58 functions as follows. At the beginning of the injection cycle, the valve element 60 rests against the first valve seat 62 so that the connection 59 of the valve chamber 68 to the leakage oil chamber 78 is closed. The connecting conduit 74 and the outlet throttle 72 are open so that the control pressure chamber 52 and the control chamber 50 are hydraulically connected to the valve chamber 68. By means of the inlet throttle 70, the control chamber 50 is subjected to the injection pressure $P_0$, which also prevails in the high-pressure conduit 10. The same pressure $P_0$ is naturally also present in the control pressure chamber 52 because of the open connections. If fuel is to be injected through only the outer set of injection openings 130, then the actuator 46—acting via the thrust element 48—very rapidly switches the valve element 60 from the first valve seat 62 into contact with the second valve seat 64. This opens the connection from the valve chamber 68 to the leakage oil chamber 78 and closes the connecting conduit 74. Since this switching event occurs very quickly, the pressure in the control pressure chamber 52 only drops by an insignificant amount. The connection then present between the valve chamber 68 and the leakage oil chamber 78, in which a very low fuel pressure always prevails, causes the pressure in the pressure chamber 50 to drop since the inlet throttle 70 and the outlet throttle 72 are matched to each other so that more fuel can flow out of the control chamber 50 via the outlet throttle 72 than can flow in from the high pressure conduit 10 via the inlet throttle 70. This reduces the hydraulic force on the end surface 51 of the outer pressure piston 40 so that the hydraulic forces acting on the pressure shoulder 27 in the pressure chamber 26 cause the outer valve needle 20 to lift away from the seat surface 24, thus opening the outer array of injection openings 130. The movement of the outer valve needle 20 and the outer valve piston 40 continues until the end surface 51 of the outer valve piston 40 comes to rest against the intermediate disk 9. The movement of the outer valve piston in relation to the inner valve piston 42, which remains stationary, does in fact increase the volume of the control pressure chamber 52 slightly, but because of the large volume of the control pressure chamber 52 and connecting conduit 74, this also does not cause any significant drop in the pressure in the control pressure chamber.

Figure 4:
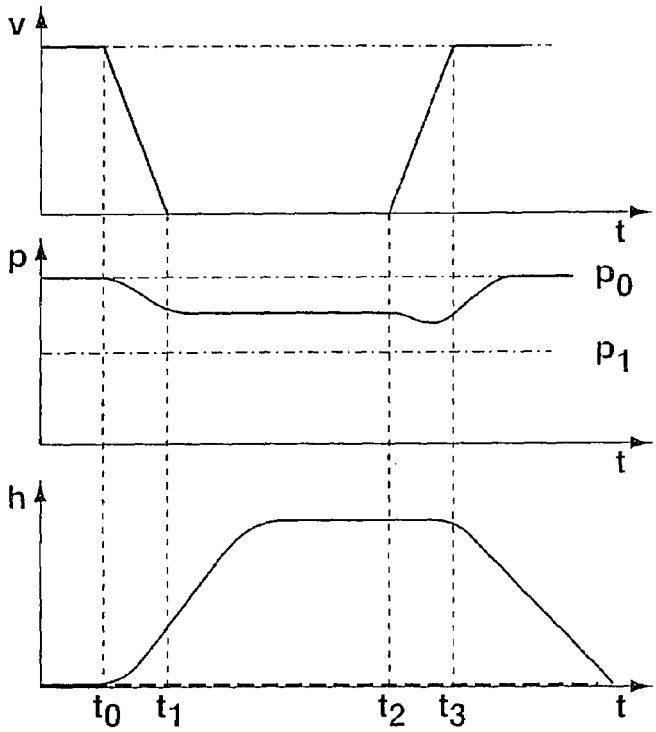
FIG. 4 shows the progression over time of the pressure, needle stroke, and valve element stroke when only the outer valve needle is opened.

FIG. 4 depicts the progression over time of the valve element travel V, the pressure p in the control pressure chamber 52, and the stroke h of the outer valve needle 20 and the inner valve needle 22. The upper graph in FIG. 4 shows the movement of the valve element 60, which starts off at a time $t_0$ and comes into contact with the second valve seat 74 at time $t_1$. The middle graph depicts the pressure p in the control pressure chamber 52, showing a pressure drop from the injection pressure $p_0$ to a pressure level above the pressure $p_1$. The pressure $p_1$ indicates the pressure at which the inner valve needle 22, driven by the hydraulic force on the inner valve sealing surface 36, lifts away from the seat surface 24. The outer valve needle 20, whose stroke h is shown in the lower graph of FIG. 4, begins its movement shortly after the time $t_0$ and continues the movement until it has reached its maximum stroke. At time $t_2$, the control valve 58 is switched again and the valve element 60 reaches its starting position against the first valve seat 62 at time $t_3$. The control chamber 50 is filled with the injection pressure of the high-pressure conduit 10 via the inlet throttle 70 and the pressure $p_0$ builds back up again in the control pressure chamber 52 as well via the connecting conduit 74. The increasing pressure in the control chamber 50 pushes the outer valve needle 20 back into its closed position.

Figure 5:
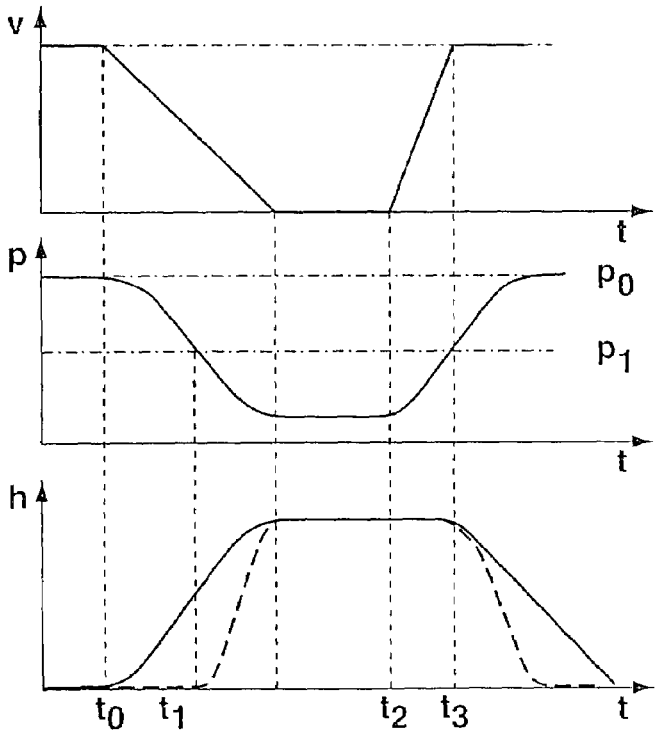
FIG. 5 shows the progression over time of the valve element stroke, pressure, and needle stroke when both valve needles are opened.

If an injection is to occur using all of the injection openings 30, then the control valve 58 is switched more slowly than in the above-described injection through the outer array of injection openings 130. Due to the relatively slow movement of the valve element 60, for a certain amount of time while the valve element 60 is disposed between the first valve seat 62 and the second valve seat 64, both the connecting conduit 74 and the connection to the leakage oil chamber 78 remain open so that the pressure in the control pressure chamber 52 falls below the opening pressure of the inner valve needle 22, the pressure $p_1$. This causes both the outer pressure piston 40 and the inner pressure piston 42 to move in the above-described manner so that both the outer valve needle 20 and the inner valve needle 22 lift away from the seat surface 24, thus opening all of the injection openings 30. In the same manner as FIG. 4, FIG. 5 shows the progression of the important values over time. The upper graph of FIG. 5 shows the slower progression of the valve element 60 movement; the movement back into the starting position against the first valve seat 62 can occur at the same speed as in the injection in the partial load range. The progression of the pressure p in the control pressure chamber 52 exhibits a decrease in pressure to below the pressure $p_1$ so that the inner valve needle 22 begins its stroke motion at time $t_1$. This is depicted by the dashed line in the bottom graph of FIG. 5. The closing of the fuel injection valve occurs in a manner analogous to that in the partial load range, through the rebuilding of the pressure in the control chamber 50 and in the control pressure chamber 52.

The actuator 46 is preferably a piezoelectric actuator that executes a stroke as a function of the voltage applied. A simple voltage regulation thus makes it possible to achieve virtually any chronological progression in the movement of the valve element 60. Other actuators can also be used instead of a piezoelectric actuator, for example rapidly switching solenoid actuators whose switching speeds can be controlled as a function of the magnetic field strength.

The foregoing relates to preferred exemplary embodiments of the invention, it being understood that other variants and embodiments thereof are possible within the spirit and scope of the invention, it being defined by the appended claims.

The invention claimed is:

1. In a fuel injection valve for internal combustion engines, having a housing (1) with a bore (16) inside it that contains a longitudinally sliding outer valve needle (20), which in turn contains a longitudinally sliding inner valve needle (22), and the end of each valve needle oriented toward the combustion chamber controls at least one injection opening (30), having a control chamber (50) that is connected via an inlet throttle (70) to a high-pressure chamber (10) whose pressure at least indirectly exerts a closing force on the outer valve needle (20), having a control pressure at least indirectly exerts a closing force on the outer valve closing force on the inner valve needle (22), and having an oil leakage chamber (78) in which a low fuel pressure always prevails, the improvement wherein the housing (1) contains a control valve (58) having a valve chamber (68) and a valve element (60) contained in it, wherein the valve chamber (68) has a connection (59) to the leakage oil chamber (78), a continuously open connection (72) to the control chamber (50), and a connection (74) to the control pressure chamber (52), wherein the valve element (60) in the valve chamber (68) can move between two end positions: in the first end position, the valve element (60) closes the connection (59) to the leakage oil chamber (78) and opens the connection (74) to the control pressure chamber (52); in the second end position, it closes the connection (74) to the control pressure chamber (52) and opens the connection (59) to the leakage oil chamber (78).

2. The fuel injection valve according to claim 1 wherein less fuel flows into the control chamber (50) via the inlet throttle (70) than flows out into the leakage chamber (78) via an outlet throttle (72) in the corresponding position of the control valve (58).

3. The fuel injection valve according to claim 1 wherein the valve element (60) is moved by an actuator (46).

4. The fuel injection valve according to claim 3, wherein the actuator (46) is operable to move the valve element (60) from the first end position to the second end position at a variable speed.

5. The fuel injection valve according to claim 3, wherein the actuator (46) is a piezoelectric actuator.

6. The fuel injection valve according to claim 4, wherein the actuator (46) is a piezoelectric actuator.

7. The fuel injection valve according to claim 1 wherein all of the connections (59; 74; 72) to the valve chamber (68) are open when the valve element (60) is disposed between the first end position and the second end position.

8. The fuel injection valve according to claim 1 wherein the valve element (60) can be moved from the first end position to the second end position so rapidly that the pressure in the control pressure chamber (52) only decreases by an insignificant amount.

* * * * *